United States Patent [19]

Lee

[11] Patent Number: 5,046,696

[45] Date of Patent: Sep. 10, 1991

[54] EYEGLASS HOLDER

[76] Inventor: Tim Lee, P.O. Box 139, Glendale, Oreg. 97442

[21] Appl. No.: 551,422

[22] Filed: Jul. 10, 1990

[51] Int. Cl.[5] ..... A47F 5/00

[52] U.S. Cl. ..... 248/309.1; 248/205.3; 248/902

[58] Field of Search ..... 248/205.3, 205.4, 902, 248/309.1, 314, 110, 315; 211/13; 224/250, 253; 206/5; D3/34; D8/373, 254

[56] References Cited

U.S. PATENT DOCUMENTS

| | | | |
|---|---|---|---|
| D. 152,254 | 1/1949 | Gallo . | |
| D. 173,295 | 10/1954 | Wantz . | |
| 851,327 | 4/1907 | Thompson . | |
| 2,997,270 | 8/1961 | Farndon . | |
| 3,259,348 | 7/1966 | Dann . | |
| 3,367,610 | 2/1968 | Lindquist | 248/110 |
| 4,239,167 | 12/1980 | Lane | 248/902 X |
| 4,452,354 | 6/1984 | Tabachnick | 248/205.3 X |
| 4,671,416 | 6/1987 | Sorensen | 211/13 |
| 4,695,026 | 9/1987 | Medley | D8/373 |
| 4,702,451 | 10/1987 | Salazar | 248/309.1 |
| 4,894,887 | 1/1990 | Ward, II . | |

*Primary Examiner*—J. Franklin Foss

*Attorney, Agent, or Firm*—Klarquist, Sparkman, Campbell, Leigh & Whinston

[57] ABSTRACT

The present invention is a holder for eyeglasses which may accept the temple portion of an eyeglass frame for supporting the eyeglasses in a vertical position and which may be mounted onto any surface, for instance, an automobile, a boat, or at a convenient position in the home environment for holding the eyeglasses. A molded plastic eyeglass holder has flat, planner, first member having a first surface and a second surface. The first surface has second member molded integrally to the first surface of the flat, planer member and protruding outwardly therefrom. An opening between the first member and the second member and the second member accepts the temple of an eyeglass frame. An adhesive material is applied to the second surface of the first member and protected by a release sheet. Removal of the release sheet allows the eyeglass holder to be pressed against a surface and adhered thereto.

14 Claims, 1 Drawing Sheet

EYEGLASS HOLDER

TECHNICAL FIELD

The present invention relates to a holder for eyeglasses or sunglasses and particularly to a holder which can be attached to a surface and which accepts a temple of the eyeglasses for holding the eyeglasses.

BACKGROUND ART

Eyeglasses and sunglasses typically are comprised of a frame supported on the bridge of the nose to which right and left temple pieces are attached to extend along the side of the wearer's head to a point past the ears so that the cooperation between the supports of the bridge of the nose and ears maintains the eyeglass or sunglass frame in place with the lenses positioned directly in front of the eyes.

Typically, eyeglasses and sunglasses are sold with either a hard or a soft case for holding the glasses when not in use. Various auxiliary or temporary holding devices have also been developed for holding sunglasses or eyeglasses when not in use, for instance, near a reading stand, in an automobile, or in a boat. The object of these devices is to hold the glasses securely to prevent damage to the glasses and yet have the glasses be readily accessible to the user when needed. One such device is described in U.S. Pat. No. 2,997,270 to Farndon, which discloses a rack which slidable mounts on a wall mounted bracket and which provides a flat, horizontal surface that supports the eyeglass frame with the temple pieces extending in a downward direction.

Another device is disclosed by Dann, U.S. Pat. No. 3,259,348, which is comprised of a block formed of yieldable material which is mounted to a wall. The block has a narrow neck portion which receives the nose pieces of an eyeglass frame with the temples being in a folded configuration so that they cross above the narrow neck of the notched block. Both of the above-mentioned devices, however, extend a substantial distance from the mounting surface or wall. Also, vibrations, such as those experienced in an automobile or a boat, during operation, would cause the eyeglasses to vibrate out or off of their respective supports.

Therefore, a need exists for a simple, inexpensive eyeglass holder which may be mounted on a surface and which may hold eyeglasses in a readily accessible position and prevent damage to the eyeglasses.

SUMMARY OF THE INVENTION

It is an object of the invention to provide an eyeglass holder having a flat, planar first member and a second member integrally molded to the first member and protruding from the first member and having an opening between the first member and the second member for supporting a pair of eyeglasses.

Another object of the invention is to provide an eyeglass holder which can receive a temple portion of the eyeglasses for supporting the eyeglasses.

Yet another object of the invention is to provide an eyeglass holder which can be molded from a thermoplastic material.

A further object of the invention is to provide an eyeglass holder which can easily and quickly be attached to a surface.

The present invention is a thermal plastic injection molded holder having a first member that is substantially flat and planer, having a first side and a second side. The first side of the first member has a protrusion molded thereon having an opening between the second member and the first member. The protrusion or the second member has a first portion integrally molded to the first side of the flat planer member and protruding generally perpendicular outward from the first surface. A second portion spaced apart from the first portion is integrally molded to the first side of the flat planer first member and generally protrudes perpendicularly from the surface. A third portion is integrally molded to the first portion and the second portion to form a loop. There is a space between the third member and the first flat planer member which will accept a temple piece of an eyeglass frame.

The first portion, the second portion, and the third portion may, in one embodiment, have a rectangular cross section to form a loop and in an alternate embodiment, the first portion, the second portion, and the third portion may be a continuous loop having a circular cross section.

A double-sided adhesive tape is adhered to the second side of the first member and has a releasible protective sheet thereon. Removal of the protective sheet allows the eyeglass holder to be pressed against any vertical surface and adhered thereto.

In use, the eyeglass or sunglasses are folded one temple upon the other and one temple is inserted into the opening of the holder. The eyeglasses rest upon the pivot point of the temple piece and the eyeglass frame to hold the eyeglasses in a generally vertical position such that the lenses faced outward away from the support surface and are, therefore, protected.

Other objects and advantages of the present invention will be apparent from the following description of a preferred embodiment thereof and from the attached drawings.

DETAILED DESCRIPTION OF THE INVENTION

Figure 1:
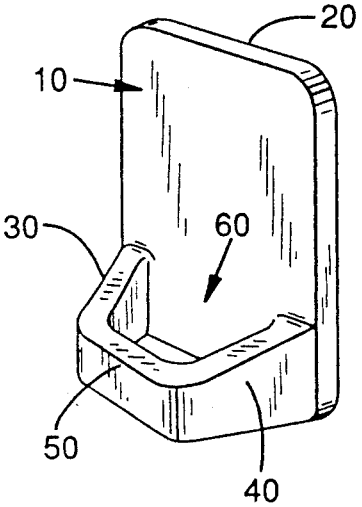
FIG. 1 is a front perspective view of the eyeglass holder of the present invention.
Figure 2:
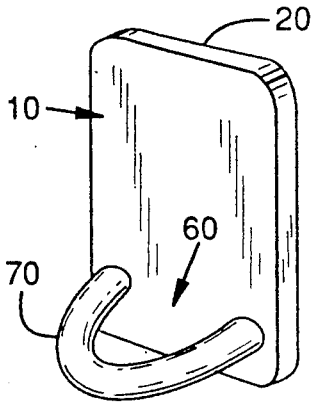
FIG. 2 is a perspective view of an alternate embodiment of the eyeglass holder of the present invention.
Figure 3:
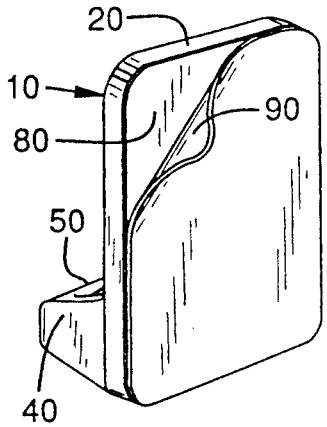
FIG. 3 is a rear perspective view of the eyeglass holder of the present invention shown in FIG. 1.

Referring now to FIGS. 1, 2, and 3, the eyeglass holder consists of a first member being flat and planer and having a first surface 10 and a second surface 20.

A second member protrudes from the first surface 10 of the first member and has first portion 30 integrally molded to the first surface 10. A second portion 40 of the second member is integrally molded to the first surface 10 of the first member. Both the first portion 30 and the second portion 40 of the second member protrude generally perpendicularly outward from the first surface 10 of the first member. In a preferred embodiment, the first surface 10 has a lower edge which aligns with the lower edges of the first portion 30 and the second portion 40. A third portion 50 of the second member is integrally molded to the first portion 30 and the second portion 40 and is generally parallel to the first surface 10 of the first member. This configuration provides an opening 60 between the third portion 50 of the second member and the first surface 10 of the first member. This opening is adapted to receive the temple piece of an eyeglass frame.

Figure 5:
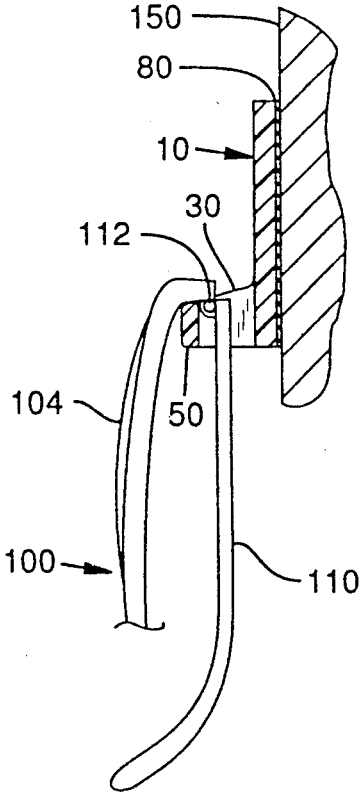
FIG. 5 is a sectional side view of the eyeglass holder of the present invention taken along lines 5—5 of FIG. 4.

In a preferred embodiment, when the holder is mounted to a vertical surface, as shown in FIG. 5, the first portion 30 and the second portion 40 each have a surface which slopes downwardly, preferably at an angle of about 15 degrees from the perpendicular to the first surface 10. This slope will encourage an eyeglass frame hanging on either the first portion 30 or the second portion 40 to slide onto the third portion 50, where the eyeglass frame will be separated by a maximum distance from a support surface 150, thereby reducing the risk of damage to the eyeglasses and making them easier to grasp to remove them. Consequently, eyeglasses may be stowed or removed with one hand, making the holder suitable for safe use by the driver of an automobile.

As can be seen in FIG. 1, the first portion 30, the second portion 40, and the third portion 50 of the second member may have a generally rectangular cross section with the edge rounded. The rounded edges prevent any scratching of any of the surfaces of the eyeglasses.

An alternate embodiment shown in FIG. 2 has the first portion, the second portion, and the third portion integrally molded as a single loop of material 70 with an opening between the second member 70 and the first side 10 of the first member.

As shown in FIG. 3, a piece of double sided adhesive 80 is adhered to the second side 20 of the flat planer member. This double sided adhesive attachment 80 has its first side adhered to the second side 20 of the flat planer member and has its second side protected by a release sheet 90. In operation, the release sheet 90 is removed and the eyeglass holder is adhered to any vertical surface 150 as shown in FIG. 5.

Figure 4:
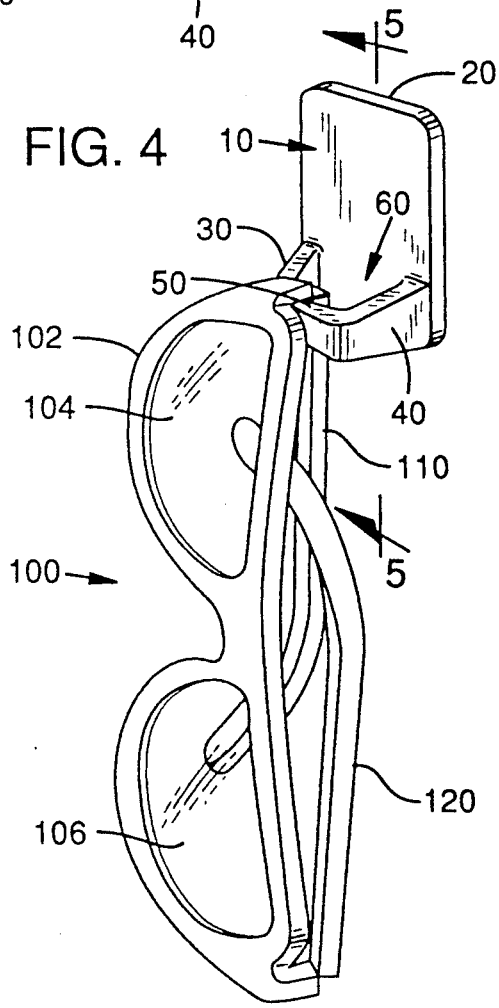
FIG. 4 is a front perspective view of the eyeglass holder of the present invention mounted on a surface with a pair of eyeglasses held by the holder.

Referring now to FIG. 4, a pair of eyeglasses or sunglasses typically has a frame 100. The frame has a front piece 102 for holding eyeglass lenses 104 and 106. A first temple piece 110 is attached to the frame 102 by means of a pivot 112. Similarly, a second temple piece 120 is attached to the frame 102 by means a pivot point 122. In operation, the temple piece 120 and 110 are folded back flat against the eyeglass frame 102. One of the temple pieces, for instance 110 as shown in FIG. 4, is inserted into the opening 60 in the eyeglass holder. Gravity holds the eyeglasses vertically in the holder with the pivot point 112 resting upon the third member 50. In this manner, as is shown in FIG. 5, the eyeglass lenses 104 and 106 project outwardly away from the support surface 150 to prevent any damage to the eyeglass lenses themselves.

It can be seen in FIG. 4 and FIG. 5 how the eyeglasses are readily accessible for use by merely lifting up on the frame 102 and pulling the temple piece 110 out of the opening 60 of the eyeglass holder.

It can also be seen that either temple piece 120 or temple piece 110 may be inserted into the opening 60.

Similarly, it may be seen that the third portion 50 or the portion 70 extends only a short distance away from the mounting surface 150.

It will also be noted by anyone skilled in the art that the double-sided adhesive tape 80 may be a thin sheet of adhesive tape, it may be a foamed adhesive material or it may be other mounting means such as hook-n-loop fasteners or any other glue type surface.

Of course, it should be understood that a wide range of changes and modifications can be made to the preferred embodiments described above. It is therefore intended that the foregoing descriptions be regarded illustrative rather than limiting, and that it be understood that it is the following claims, including all equivalents, which are intended to define the scope of the invention.

I claim:

1. A holder for a pair of eyeglasses having a lens frame and a pair of temples, said holder comprising:

a first member of injection molded thermoplastic, said first member being flat and planar and having a first side and a second side;

a second member integrally molded to said first member, said second member protruding from the first side of said first member and forming a bounded opening between said first member and said second member for receiving a temple of said eyeglasses the second member forming a loop having an upper surface sloping downwardly away from the first member when the first member is vertically oriented, whereby an eyeglass supported in said holder slides downwardly are away from the first member; and an attachment means on said second side of said first member for attaching said first member to a surface.

2. An eyeglass holder as recited in claim 1 wherein said attachment means is a sheet of double sided adhesive tape having a first tape side and a second tape side, said first tape side attached to said second side of said first member.

3. An eyeglass holder as recited in claim 2 wherein said second tape side has a removable release sheet temporarily adhered thereto.

4. An eyeglass holder as recited in claim 1 wherein said second member is molded integrally with said first member and said second member forms a loop protruding from said first member and said second member having a rectangular cross-section.

5. The eyeglass holder of claim 1 wherein the second member is positioned at the lower edge of said first member when the latter is vertically oriented.

6. An eyeglass holder comprising:

a molded thermoplastic having at least one flat planar surface;

a protrusion generally perpendicularly extending from said flat planar surface the protrusion having a top surface sloping downwardly away from the flat planar surface when the flat planar surface is vertically oriented;

an opening between said protrusion and said flat planar surface for accepting a temple of a pair of eyeglasses inserted therein; and an attachment means to attach said flat planar surface to a mounting surface.

7. An eyeglass holder as recited in claim 6 wherein said attachment means is a sheet of double sided adhesive tape having a first tape side and a second tape side, said first tape side attached to said flat planar surface and said second tape side for attachment to said mounting surface.

8. An eyeglass holder as recited in claim 6 wherein said protrusion includes a loop of thermoplastic material having a first portion molded perpendicularly to said flat planar member, a second portion spaced apart from said first portion, said second portion molded perpendicularly to said flat planar member; and a third portion, parallel to said flat planar member and interconnected to said first portion and said second portion.

9. An eyeglass holder as recited in claim 8 wherein said first portion, said second portion, and said third portion each have a rectangular cross-section.

10. An eyeglass holder as recited in claim 8 wherein said first portion, said second portion, and said third portion each have a circular cross-section.

11. An eyeglass holder as recited in claim 6 wherein said flat planar member has a thickness of between one-eighth of an inch and one-quarter of an inch.

12. The eyeglass holder of claim 6 wherein the protrusion is positioned at the lower edge of the flat planar surface when the latter is vertically oriented.

13. An eyeglass holder comprising:

a first member of injection molded thermoplastic, said first member being flat and planar and having a first side and a second side;

a second member integrally molded to said first member, said second member including a first portion molded integrally to the first side of said first member and protruding outwardly therefrom, a second portion spaced apart from said first portion and molded integrally to the first side of said first member and protruding outwardly therefrom, and a third portion parallel to the first side of said first member an integrally molded to said first member and said second member thereby forming an opening between said first member and said second member, the first and second portions having top surfaces sloping downwardly away from the flat member when the flat member is vertically oriented; and a double sided adhesive material attached to the second side of said first member for attaching said eyeglass holder to a surface.

14. The eyeglass holder of claim 13 wherein the second member is positioned at the lower edge of the first member when the latter is vertically oriented.

* * * * *

UNITED STATES PATENT AND TRADEMARK OFFICE

CERTIFICATE OF CORRECTION

PATENT NO. : 5,046,696

DATED : September 10, 1991

INVENTOR(S) : Tim Lee

It is certified that error appears in the above-identified patent and that said Letters Patent is hereby corrected as shown below:

On the title page,
In the Abstract:

Line 7, "planner" should be --planar--.
Line 10, "planer" should be --planar--.
Lines 12 and 13, delete second occurrence of "and the second member".

Column 1, line 68, "planer" should be --planar--.
Column 2, line 5, "planer" should be --planar--.
Column 2, line 8, "planer" should be --planar--.
Column 2, line 13, "planer" should be --planar--.
Column 2, line 56, "planer" should be --planar--.
Column 2, line 59, "has first" should be --has a first--.
Column 3, line 26, "edge" should be --edges--.
Column 3, line 35, "planer" should be --planar--.
Column 3, line 38, "planer" should be --planar--.
Column 3, line 47, "means a" should be --means of a--.

UNITED STATES PATENT AND TRADEMARK OFFICE

CERTIFICATE OF CORRECTION

PATENT NO. : 5,046,696

DATED : September 10, 1991

INVENTOR(S) : Tim Lee

It is certified that error appears in the above-identified patent and that said Letters Patent is hereby corrected as shown below:

Column 6, line 12, "an" should be --and--.

Signed and Sealed this

Sixteenth Day of March, 1993

*Attest:*

STEPHEN G. KUNIN

*Attesting Officer*

*Acting Commissioner of Patents and Trademarks*